United States Patent [19]

Holt

[11] Patent Number: 5,059,072

[45] Date of Patent: Oct. 22, 1991

[54] CUSHIONED RETRACTABLE HITCH FOR RAILWAY CARS

[75] Inventor: Jan D. Holt, St. Charles, Mo.

[73] Assignee: ACF Industries, Incorporated, Earth City, Mo.

[21] Appl. No.: 550,314

[22] Filed: Jul. 9, 1990

[51] Int. Cl.[5] ..... B60P 3/06; B61D 3/16

[52] U.S. Cl. ..... 410/60; 410/62

[58] Field of Search ..... 280/433, 434, 435, 436, 280/437, 438.1, 439, 440, 441; 410/52, 56, 57, 58, 59, 60, 61, 62, 63, 64

[56] References Cited

U.S. PATENT DOCUMENTS

| | | | |
|---|---|---|---|
| 3,164,346 | 1/1965 | Bateson | 410/62 X |
| 3,246,866 | 4/1966 | Price et al. | 410/62 |
| 3,497,169 | 2/1970 | Enochian | 410/60 |
| 3,544,050 | 12/1970 | Hammonds | 410/63 |
| 4,002,316 | 1/1977 | Parchmont | 410/63 |
| 4,074,633 | 2/1978 | Hicks, Jr. et al. | 410/63 X |
| 4,239,429 | 12/1980 | Stoller et al. | 410/60 X |
| 4,557,647 | 12/1985 | Hesch et al. | 410/58 |
| 4,723,879 | 2/1988 | Holt | 410/63 |

*Primary Examiner*—Frank E. Werner
*Assistant Examiner*—James Eller
*Attorney, Agent, or Firm*—Polster, Polster and Lucchesi

[57] ABSTRACT

A trailer hitch (1) for use on a railcar (C) is movable between an erect position and a retracted position. A first strut (9) has its lower end pivotally mounted to the railcar. A second strut (25) has its lower end movable in a horizontal direction relative to the railcar. A hitch head (3) is carried on the upper ends of the struts for engaging a trailer loaded on the railcar to hold it in place. A cushioning unit (49) is carried by the second strut to cushion the trail from impacts. A latching mechanism (57) automatically latches the hitch in its erect position and maintains it there. The latching mechanism also allows for a safe release of the hitch so it can be retracted.

9 Claims, 3 Drawing Sheets

CUSHIONED RETRACTABLE HITCH FOR RAILWAY CARS

BACKGROUND OF THE INVENTION

This invention relates to an over-the-road trailer hitch for use on intermodal railway cars, and in particular, to a cushioned hitch for such use.

In U.S. patent application Ser. No. 403,318, which is assigned to the same assignee as the present application, there is described a trailer hitch for use on so-called "piggy back" intermodal railway cars to secure over-the-road trailers on a railcar. This prior hitch was retractable and included a latch for locking it in an erect position and a release which when actuated allowed the hitch to move to a retracted position. While the hitch described in the above-noted co-assigned application works well for its intended purpose, this prior hitch was not cushioned, and as such, was intended for service on a cushioned railcar so as to limit the effects of impact loads on the trailers carried on the railcar held in place by the hitch.

Thus, there has been a need for a cushioned hitch which can be used on a "non-cushioned" car (i.e., a car having a standard draft gear) which can readily be latched in its erect position and which can readily be selectively retracted. However, in order to incorporate a cushioning unit in the hitch, the prior latching and release mechanisms could not be used. This created the problem of being able to provide a hitch which is automatically latched in its erect position, maintained there during use, and then readily and safely retracted.

Reference may be made to the co-assigned U.S. Pat. No. 4,723,879 which describes an elastomeric trailer hitch cushion utilized with a non-retractable hitch.

SUMMARY OF THE INVENTION

It is an object of the present invention to provide a hitch for use on intermodal or "piggy back" railway cars to securely hold and support over-the-road trailers thereon.

Another object of the invention is to provide such a hitch which is cushioned for absorbing impact loads which occur during movement of the railcar thereby to protect the lading being transported in a trailer supported by the hitch.

Yet another object of the invention is to provide such a cushioned hitch which may readily be automatically and positively latched in its erect position.

A further object of the invention is to provide such a hitch which enables a railyard worker or trainman to readily retract the hitch from either side of the railcar.

In accordance with this invention, generally stated, a trailer hitch is for use on a railcar and is movable between an erect position and a retracted position A first strut has one end pivotally mounted to the railcar. A second strut has one end movable in horizontal direction across the railcar A hitch head is carried by the struts for supporting a trailer on the railcar. A cushioning unit is carried by the second strut to cushion the trailer from impact loads. A latching mechanism automatically latches the hitch in its erect position and maintains it there. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
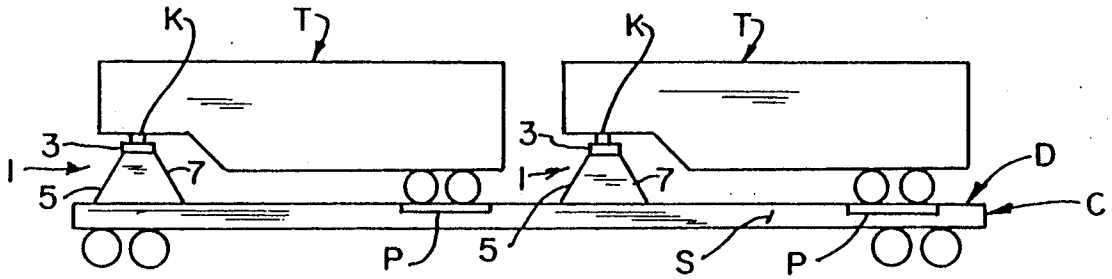
FIG. 1 is a representation of a spine-type intermodal railcar for transporting over-the-road trailers and illustrates two hitches of the present invention installed thereon, it being understood that hitches of the present invention can be used on other type cars as well.

Referring to the drawings, a retractable trailer hitch of the present invention is indicated generally at 1. As shown in FIG. 1, hitch 1 is for use on an intermodal railroad car C of a type used to transport over-the-road trailers T. Car C is shown to be a "spine" type railcar having an elongate center through sill or beam S extending lengthwise of the car and having an upper surface constituting a deck D. Car C is sufficiently long such that multiple (e.g., two) trailers T are transportable on the car, the front of each trailer being supported by a respective hitch 1. As shown in FIG. 1, two trailers T are loaded on car C. On opposite sides of the center through sill S, intermittent platforms P are provided for supporting the wheels of trailers T. As is well known in the art, trailers T are preferably hoisted onto car C so that their wheels rest on platforms P and so that the front of the trailer is supported on a respective hitch 1. However, within the broader aspects of this invention, those skilled in the art will recognize that hitches 1 of the present invention may be utilized with drive on-drive off intermodal railcars as well, and that the hitches can also be used on other type railroad cars such as single trailer cars, flush deck cars, articulated cars, etc.

Hitch 1 is preferably erected prior to loading a trailer T on the car C. The hitch has a hitch head 3 for capturing and holding a king-pin K of the trailer and to support the front of the trailer during its transport. At its destination, the king-pin is released from the hitch head 3 and the trailer is off-loaded. With respect to the erection of a railcar hitch, v reference may be made to the co-assigned U.S. Pat. No. 4,264,250 which is incorporated herein by reference. With respect to the design of hitch heads for capturing and holding the king-pin of a trailer, reference may be made to the following co-assigned U.S. Pat. Nos. 4,563,117, 4,397,594, 4,221,397, and 4,193,350 all of which are also incorporated herein by reference.

Figure 2:
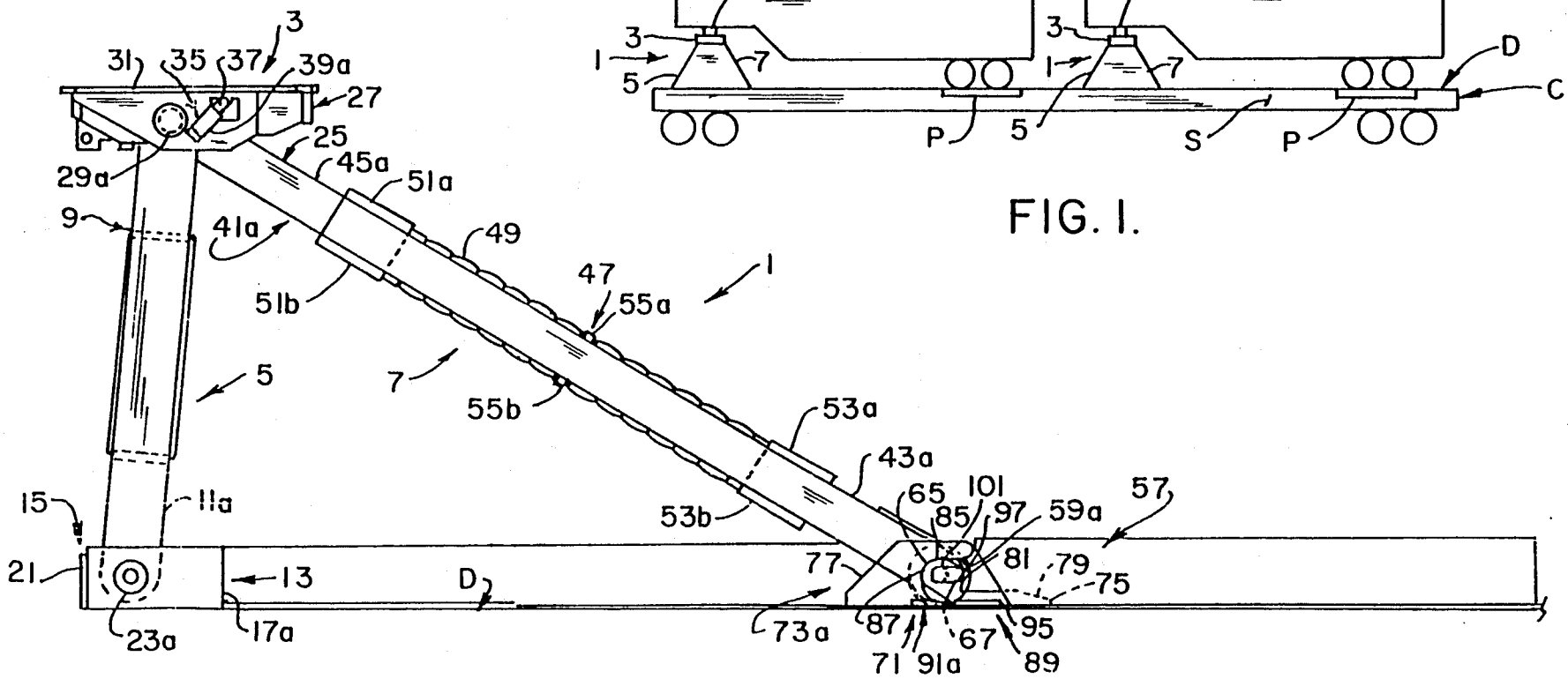
FIG. 2 is a side elevational view of the hitch of the present invention in its raised or erect position.

Referring to FIG. 2, hitch 1, whose components are axially aligned with the longitudinal centerline of car C, includes a first support means 5 and a second support means 7 for supporting hitch head 3. Means 5 comprises a generally vertical (when erected) strut 9, the lower end of which is pivotally mounted to deck D of railcar C Strut 9 has a pair of parallel, spaced apart legs 11*a* and 11*b*. The lower ends of each leg 11*a*, 11*b* are received in a mounting means 13 which comprises a lug assembly 15. The lug assembly is attached to deck D and aligned so as to permit pivotal movement of the first support means about an axis perpendicular to the longitudinal axis of the railcar as hitch 1 is moved between its erected and retracted positions. The lower end of each strut leg 11*a*, 11*b* received in lug assembly 15 is fitted in a pocket formed by sidewall 17*a*, 17*b* of the lug assembly and by brackets 19*a*, 19*b* which extends rearwardly from and perpendicular to a front plate 21 of the lug assembly A respective strut pin 23*a*, 23*b* extends through corresponding openings in the sidewalls, strut leg and bracket to pivotally mount each of the legs 11*a*, 11*b* of strut 9 to the deck so the strut can be pivotally raised and lowered.

Figure 3:
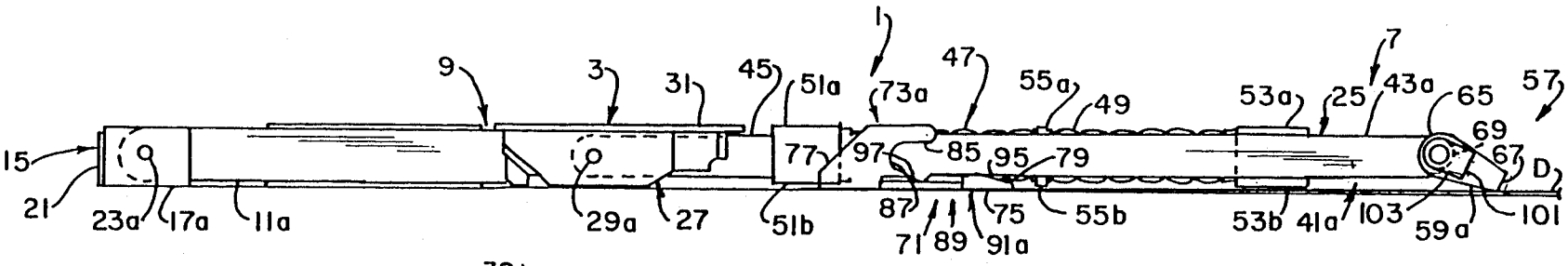
FIG. 3 is a side elevational view of the hitch in its retracted position.

Second support means 7 comprises a diagonal strut 25, the lower end of which is translatable (slidable) in a horizontal direction over the deck and which is pivotal about a transverse, horizontal axis as it is translated longitudinally of the car between a first or hitch erect position (see FIG. 2) and a second or hitch retracted position (see FIG. 3). As shown in FIG. 2, strut 9 is generally vertical (but leans somewhat toward diagonal strut 25) when the hitch is in its erect position and strut 25 extends generally diagonally between the upper end of strut 9 and the deck when the hitch is erect.

Figure 4:
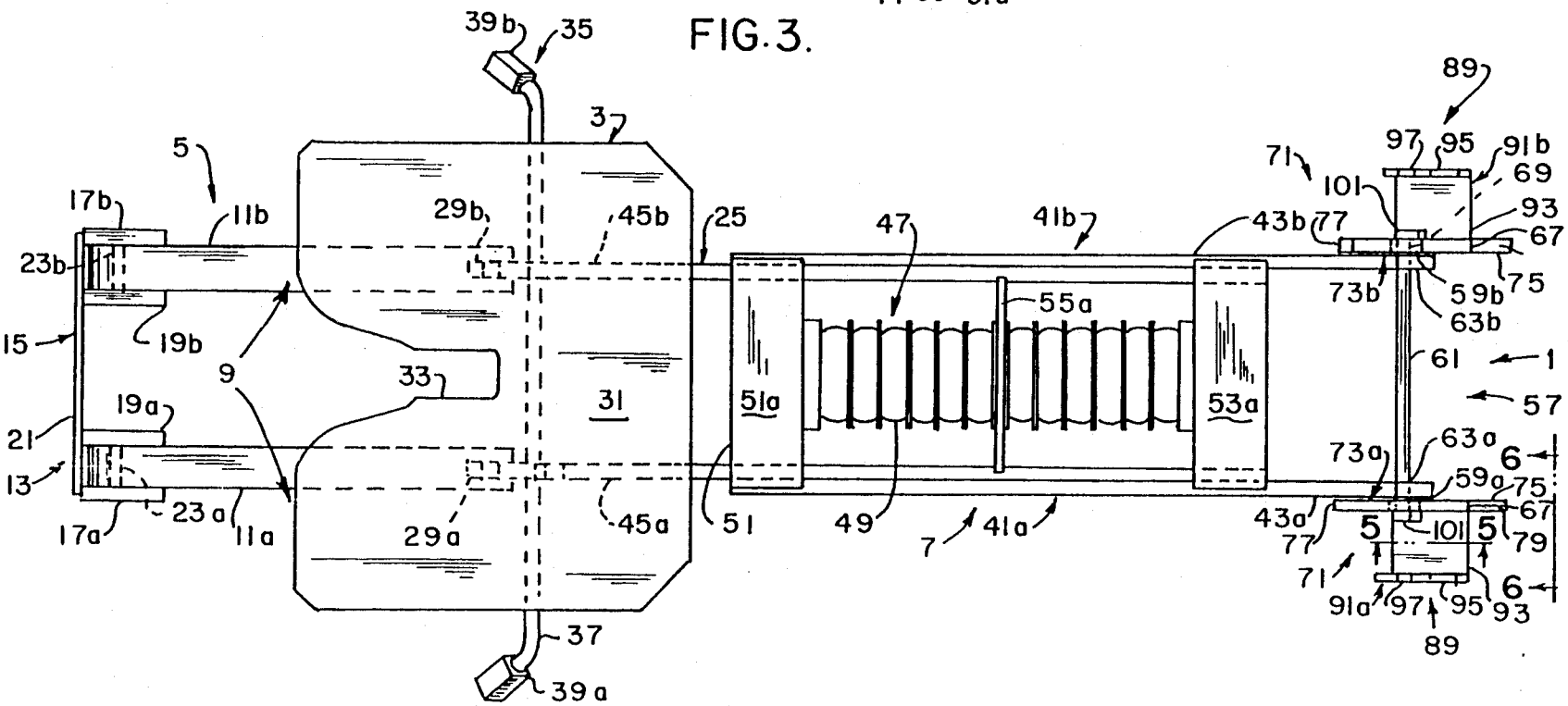
FIG. 4 is a top plan view of the hitch on a somewhat enlarged scale in its erect position.

Hitch head 3 is commonly pivotally carried on the respective opposite or upper ends of struts 9 and 25, and, as noted, is elevated a required distance above deck D when the hitch is erect. Since the hitch head structure is fully described in the above mentioned patents incorporated herein by reference and is commercially available from the assignee of the present invention, ACF Industries, Incorporated, under its trade designation Model 6, the construction of the hitch head will not be given in detail. The hitch head includes a head weldment 27 which is pivotally connected to the upper ends of struts 9 and 25 by respective strut pins 29*a*, 29*b*. The weldment includes a top plate 31 having a notch 33 (see FIG. 4) extending rearwardly from the front of the weldment The notch receives king-pin K (see FIG. 1). Hitch head 3 has operable and closable jaws (not shown) which grip king-pin K to hold trailer T in place during movement of the railcar. A handle assembly 35 includes a rod 37 extending crosswise of the weldment beneath plate 31. The rod projects outwardly beyond both sides of the hitch head and is downwardly turned at its respective outer ends. A socket 39*a*, 39*b* is formed at each outer end of the rod for rail yard personnel to insert a tool (not shown) in either socket. By rotating rod 37 with the tool, the king-pin jaws released to permit off loading of the trailer from the railcar. It will be appreciated that the king-pin may be released by turning rod 37 from either side of the railcar.

Strut 25 has a pair of parallel spaced apart legs 41*a*, 41*b*. Each leg has a first and fixed segment 43*a*, 43*b*, when the hitch is erect; and a second leg segment 45*a*, 45*b*, which is movable with respect to the first leg segments. Thus, the respective upper ends of leg segments 45*a*, 45*b* are connected to hitch head 3 by the pins 29*a*, 29*b*.

Hitch 1 is a cushioned hitch employing a cushioning means, as generally indicated at 47, carried by strut 25. Means 47 includes a cushioning unit 49 which is commercially available from Miner Enterprises, Inc. of Geneva, Illinois, under their trademark "TEC-PAK". The cushioning unit utilizes an elastomeric material which functions as an impact absorber to cushion the trailer, and its lading, from impacts occurring while the trailer is connected to the hitch Unit 49 is attached to strut 25 by upper and lower plates or stops 51*a*, 51*b*, and 53*a* and 53*b*, respectively, and by intermediate plates 55*a*, 55*b*. The cushioning unit is shown to comprise alternating metal plates 56*a* and elastomeric rings 56*b* interposed between upper and lower plates 51*a*, 51*b* and 53*a*, 53*b* such that upon an impact load being applied to railcar C are absorbed through compression of the elastomeric rings 56*b*. In effect, the unit acts as a spring with a high hysterisis so as to reduce the maximum kingpin force at the trailer.

As shown in FIG. 2, the upper end of leg segments 43*a*, 43*b* are attached to plates 51*a*, 51*b*, as is the upper end of the cushioning unit. The lower end of leg segments 45*a*, 45*b* are attached to plates 53*a*, 53*b*, as is the lower end of the cushioning unit. Intermediate plates 55*a*, 55*b* extend between leg segments 45*a*, 45*b*, the plates acting to support the cushioning unit midway along its length. As installed, the cushioning unit allows the upper leg segments of strut 25 to move relative to the lower leg segments when an impact or jolt occurs. The cushioning unit acts to absorb the impact energy transmitted through the hitch so the effect of the impact on the trailer and its contents is minimal.

Figure 5:
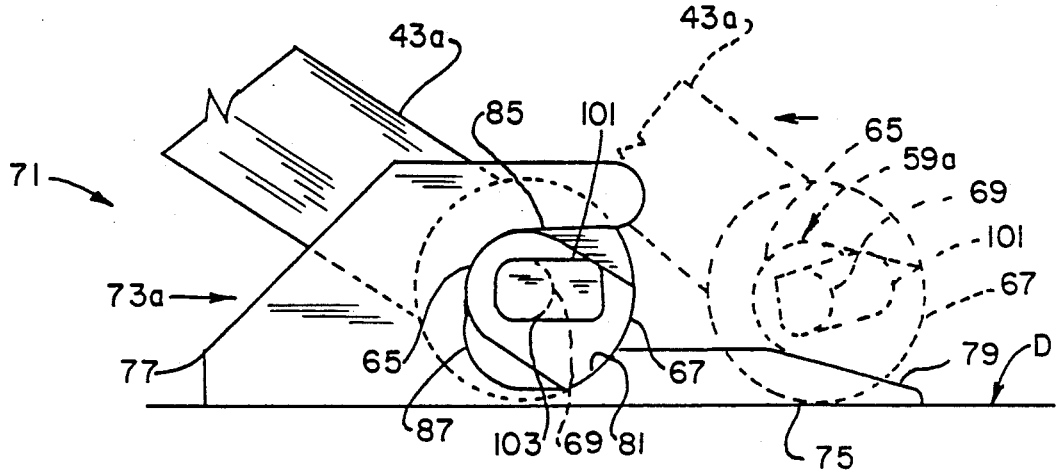
FIG. 5 is an enlarged partial side elevational view of the hitch taken along line 5—5 in FIG. 4; and, FIG. 6 is an enlarged partial rear elevational view of the hitch taken along line 6—6 in FIG. 4.
Figure 6:
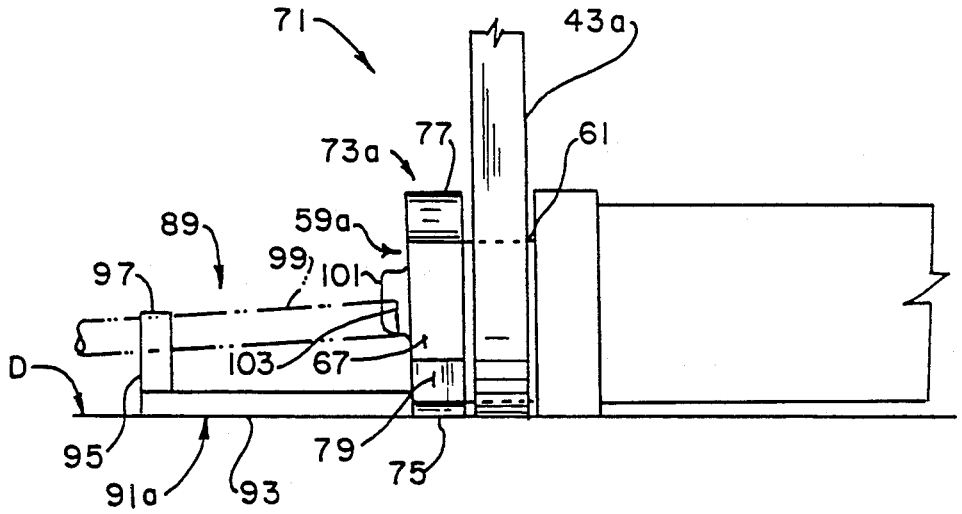

Hitch 1 further includes a latching mechanism 57 for automatically latching the hitch in its erect position as the hitch is raised to its erect position and for maintaining it there as the railcar C is moved on a route while a trailer T is secured to the railcar and supported by the hitch. Referring to FIGS. 5 and 6, the latching mechanism includes a pair of latch members or pawls 59*a*, 59*b* carried on the ends of a transverse shaft 61. Shaft 61, which comprises a tube, extends transversely of strut 25 and through respective transverse openings 63*a*, 63*b* in the lower end of leg segments 43*a*, 43*b*. Each latch member 59*a*, 59*b* has a rounded forward face 65 and rounded rear face 67. Each latch member also has an opening 69 formed on its face for receiving the respective outer end of rod 61.

Latching mechanism 57 further includes means 71 for capturing each latch member 59*a*, 59*b* and holding it in place. A lug 73*a*, 73*b* is installed on deck D of the railcar outwardly of the legs 43*a*, 43*b* of strut 25. The lugs are in-line with the respective paths of the latching members and each lug includes a ramp section 75 and a stop section 77. Ramp section 75 has a rearwardly sloping ramp face 79 (as seen in FIGS. 2, 3 and 5) over which the latch member is drawn as the hitch is erected. The ramp section further has a forwardly sloping ramp face 81 at the forward end of face 79. As the hitch reaches its erect position, face 67 of the latch member slides down ramp face 81. Face 67 of the latch member and ramp face 81 of the lug are matingly contoured for the latch member to seat against the ramp face and latch strut 25 and the hitch in place. Since the weight of the hitch is transferred through the strut legs, the matching contour of the latch member face and forward ramp face of the lug allow the force of the weight to be directed into the deck through the lug so the hitch is held firmly in its erect position.

Stop section 77 of the lug is forward of the ramp section. The stop section has a forwardly extending slot 83 shaped to receive the forward end 65 of the latch member. During erection of hitch 1, end 65 of the latch member bears against the forward end 85 of the slot, as the hitch reaches its fully erect position. The stop section of the lug then prevents any further forward movement of strut 25, just as the ramp section of the lug now prevents any rearward movement of the strut. Consequently, the hitch is automatically latched in its erect position with strut 25 captured in place. Further movement of the strut is now prevented.

Once a trailer's kingpin is disconnected from hitch head 3 and the trailer removed from the car, it may be desirable to retract hitch 1. For this purpose, latching mechanism 57 further includes a release means, as generally indicated at 89. Means 89 includes a pair of fulcrum pads 91*a*, 91*b*. These pads are installed on deck D outwardly of, and aligned with, lugs 73*a*, 73*b*. Each pad includes a plate 93 which sits atop deck D. The inner end of the plate abuts the outside of its associated lug. A vertically projecting fulcrum 95 extends upwardly from the outer end of each plate. Each fulcrum has a notch 97 in its upper end for a tool 99 (see FIG. 6) to be set in the notch. The notch is centered approximately midway along the length of the fulcrum. Each latch member has an outwardly projecting ear 101 extending from the outer face of the latch member. The ear is of an elongate shape and is so oriented with respect to the latch member as to be generally parallel to the surface of the deck when the hitch is latched (see FIG. 5). The underside 103 of the ear is flat (as shown in FIG. 5), or contoured (as shown in FIG. 6) for the end of tool 99 to fit under the ear.

To retract hitch 1, a railyard worker can stand on either side of the car and insert an end of tool 99 beneath the respective ear 101 on a latch member. Then, using the fulcrum pad, he can lift the latch member until its rear face 67 clears the forwardly sloping ramp face 81 of the lug. The hitch will now retract under the weight of the struts and the hitch head. At all times during the operation, the worker is located away from the hitch.

In view of the above, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

What is claimed is:

1. A trailer hitch for use on a railcar, the hitch being movable between an erect position and a retracted position and comprising:

first support means comprising a first strut one end of which is pivotally mounted to the railcar for movement between the hitch erect and hitch retracted positions;

second support means comprising a second strut having a pair of parallel, spaced apart legs, one end of the second strut being rectilinearly movable in a horizontal direction as the hitch is moved between the hitch erect and the hitch retracted positions, the first strut being inclined with respect to the second strut so that upon unlatching of the hitch, the hitch is gravity biased to move toward the hitch retracted position;

a hitch head supported by said first and second support means for supporting a trailer on the railcar and for holding the trailer in place;

cushioning means carried by said second support means for cushioning the trailer from impacts to which the trailer may be subjected during transport thereof; and, means for latching the hitch in the hitch erect position and maintaining the hitch there, said latching means including a pair of latching members movable by said second strut, a rod extending transversely of said second strut across the movable end thereof, the respective latching members being attached to said rod for movement thereby, and means for capturing each latching member and holding the latching member in place, the capturing means including a lug having a ramp section and a stop section which is forward of the ramp section in the direction of movement of said second strut, the ramp section having a rearwardly sloping face over which a respective latching member is drawn as the second strut is moved to erect the hitch, and a forwardly sloping ramp face against which the latching member bears when the hitch is erect and which prevents rearward movement of the latching member which would retract the second strut, the stop section including a forwardly extending slot into which the latching member is drawn as the second strut moves forwardly, with the forward end of the slot stopping further forward movement of the second strut as the hitch reaches the hitch erect position.

2. The hitch of claim 1 further including means for pivotally mounting one end of said first strut to the railcar.

3. The hitch of claim 1 wherein said second strut comprises a pair of parallel, spaced apart legs, each leg having a first segment fixed with respect to said railcar when the hitch is erect, and a second segment movable relative thereto, said cushioning means including a cushioning unit installed on the strut between first and second segments for cushioning movement therebetween.

4. The hitch of claim 3 wherein said latching means includes at least one latching member movable by said second strut, and means for capturing the latching member and holding the latching member is place thereby to maintain the hitch in the hitch erect position.

5. The hitch of claim 1 further including release means for retracting the hitch.

6. The hitch of claim 5 wherein the release means includes fulcrum means positioned outwardly of each latch member and a strut release formed on the outer face of each latching member, the fulcrum means providing a fulcrum for a prying tool, one end of which is set beneath the associated strut release for the tool to lift the release and move the latching member off the forwardly sloping ramp face.

7. A trailer hitch for use on a railcar, the hitch being movable between an erect position and a retracted position, the hitch comprising:

a first strut having one end pivotally mounted to the railcar for movement between the hitch erect and hitch retracted positions;

a second strut having one end movable in a horizontal, axial direction on said railcar as said hitch is moved between the hitch erect and hitch retracted positions, said second strut including a pair of parallel, spaced apart legs, each leg having a first segment slidably movable with respect to said railcar and a second segment movable relative to said first segment when the hitch is in the hitch erect position;

a hitch head supported by the struts for supporting a trailer loaded on the railcar when the hitch is erect;

a cushioning unit carried by said second strut and installed between said first and second segments for cushioning said trailer from impacts; and, means for latching the hitch in the hitch erect position and for maintaining the hitch there as the hitch is moved to the hitch erect position, said latching means comprising a pair of latching members and a rod extending transversely of said second strut between the legs thereof, the respective latching members being mounted on the rod outwardly of the legs of the second strut, and means for capturing each latching member and holding the latching member in place, the capturing means including a lug having a ramp section and a stop section which is forwardly of the ramp section in the direction of second strut movement, each ramp section having a rearwardly sloping ramp face over which the respective latching member is drawn as the second strut is moved to erect the hitch, and a forwardly sloping ramp face against which the latching member bears when the hitch is erect thereby preventing rearward movement of the latching member which would retract the strut, and the stop section including a forwardly extending slot into which the latching member is drawn as the second strut moves forwardly, the forward end of the slot stopping further forward movement of the second strut as the hitch reaches the hitch erect position.

8. The hitch of claim 7 further including release means for retracting the hitch.

9. The hitch of claim 8 wherein the release means includes fulcrum means positioned outwardly of each latch member and a strut release formed on the outer face of each latching member, the fulcrum means providing a fulcrum for a tool, one end of which is set beneath the associated strut release for the tool to lift the release and move the latching member off the forwardly sloping ramp face.

* * * * *